US010789809B2

(12) United States Patent
Hsu

(10) Patent No.: US 10,789,809 B2
(45) Date of Patent: Sep. 29, 2020

(54) GAME SYSTEM FOR JUDGING WHETHER PLAYER MAKES ADDITIONAL BET

(71) Applicant: Tien-Shu Hsu, Taichung (TW)

(72) Inventor: Tien-Shu Hsu, Taichung (TW)

( * ) Notice: Subject to any disclaimer, the term of this patent is extended or adjusted under 35 U.S.C. 154(b) by 49 days.

(21) Appl. No.: 15/680,886

(22) Filed: Aug. 18, 2017

(65) Prior Publication Data

US 2019/0057576 A1 Feb. 21, 2019

(51) Int. Cl.
*G07F 17/32* (2006.01)

(52) U.S. Cl.
CPC ..... *G07F 17/3258* (2013.01); *G07F 17/3209* (2013.01); *G07F 17/3213* (2013.01); *G07F 17/3262* (2013.01); *G07F 17/3288* (2013.01)

(58) Field of Classification Search
CPC ..... G07F 17/3244; G07F 17/3258; G07F 17/3262
See application file for complete search history.

(56) References Cited

U.S. PATENT DOCUMENTS 5,288,077 A * 2/1994 Jones ..... A63F 1/00 273/292
5,393,067 A * 2/1995 Paulsen ..... A63F 1/06 194/239
5,417,430 A * 5/1995 Breeding ..... A63F 3/00157 273/274
5,588,650 A * 12/1996 Eman ..... A63F 5/0005 273/142 B
5,711,525 A * 1/1998 Breeding ..... A63F 3/00157 273/292
5,766,076 A * 6/1998 Pease ..... G07F 17/32 463/27
5,788,574 A * 8/1998 Ornstein ..... G07F 17/3244 273/309
6,503,145 B1 * 1/2003 Webb ..... A63F 3/00157 273/292
6,789,801 B2 * 9/2004 Snow ..... A63F 3/00157 273/146
6,874,786 B2 * 4/2005 Bruno ..... A63F 3/00157 273/292

(Continued)

FOREIGN PATENT DOCUMENTS

CA 2243738 A1 * 1/2000 ..... A63F 1/00
CA 2954352 A1 * 1/2016 ..... A63F 3/00157
GB 2403429 A * 1/2005 ..... G07F 17/32

*Primary Examiner* — Steven J Hylinski
(74) *Attorney, Agent, or Firm* — Muncy, Geissler, Olds & Lowe, P.C.

(57) ABSTRACT

In the present invention, a player makes a basic bet, chooses whether to make an additional bet on an additional bet element, and executes, by utilizing a control unit, the following steps: allocating a fixed proportion of an amount of the basic bet and an amount of the additional bet to be accumulated into a payoff value; choosing to perform an additional raising game flow or a basic game flow according to the presence or absence of the additional bet; in the absence of the additional bet, performing, by the control unit, the basic game flow to generate a basic payment value; in the presence of the additional bet, performing, by the control unit, the additional raising game flow to generate an additional raising payment value; and when a game result generated by a game host conforms to the bet of a player, giving the value to the player.

29 Claims, 11 Drawing Sheets

(56) References Cited

U.S. PATENT DOCUMENTS

2004/0061288 A1* 4/2004 Snow ..... A63F 3/00157 273/274
2005/0020347 A1* 1/2005 Moshal ..... A63F 5/00 463/17
2005/0059481 A1* 3/2005 Joshi ..... G07F 17/3211 463/27
2005/0239542 A1* 10/2005 Olsen ..... G07F 17/32 463/27
2006/0068899 A1* 3/2006 White ..... G07F 17/32 463/25
2006/0135254 A1* 6/2006 Thomas ..... G07F 17/32 463/25
2006/0211474 A1* 9/2006 Walker ..... G07F 17/32 463/16
2007/0060254 A1* 3/2007 Muir ..... G07F 17/32 463/16
2007/0191088 A1* 8/2007 Breckner ..... G07F 17/3258 463/20
2007/0298873 A1* 12/2007 Nguyen ..... G07F 17/32 463/27
2008/0006996 A1* 1/2008 Frankel ..... G07F 17/32 273/142 R
2008/0119260 A1* 5/2008 Nores ..... G07F 17/3265 463/20
2008/0146344 A1* 6/2008 Rowe ..... G07F 17/32 463/42
2008/0200227 A1* 8/2008 Okada ..... G07F 17/32 463/11
2009/0111573 A1* 4/2009 Iddings ..... G07F 17/3244 463/25
2013/0053130 A1* 2/2013 Zielinski ..... G07F 17/3244 463/25
2015/0065227 A1* 3/2015 Naylor ..... G07F 17/3244 463/25
2015/0371498 A1* 12/2015 Snow ..... G07F 17/3244 463/12
2016/0335851 A1* 11/2016 Litman ..... G07F 17/3293

* cited by examiner

GAME SYSTEM FOR JUDGING WHETHER PLAYER MAKES ADDITIONAL BET

FIELD OF THE INVENTION

The present invention relates to a game system, and more particularly to a game system for automatically judging whether a player makes an additional bet.

BACKGROUND OF THE INVENTION

A croupier is not needed for a game console, there is no room for artificial cheating, manufacturing and management costs are low, the game console can be applied to multiple games such as a slot machine, poker card games, dices, runners and roulettes, the playing cost of a player is quite low, and therefore the game console is generally popular with players and dealers. In order to avoid no interest of a player in games within a short time caused by playing methods of sameness, multiple manners have existed currently to attract the player.

The design of a payoff pool is the commonest manner. When betting on a game designed with the payoff pool each time, a player will allocate a fixed proportion of a bet amount to be accumulated into the payoff pool. When the payoff pool or a game result satisfies a specified condition, the player can obtain payoffs in the payoff pool, and the player will be attracted by increasing payoffs in the payoff pool to continue playing the game.

Another manner is to provide a payoff game. The payoff game is providing an additional bonus in addition to a payment obtained by playing a basic game. This manner is characterized in that when the result of the basic game satisfies a specified condition, the payoff game will be played, and the game can be freely played without a continuous bet to obtain a certain quantity of payoffs. The player may have a feeling of earning, and therefore the payoff game can assist the game console in attracting the player to play the game.

However, on the premise of retaining earnings of the dealer, if the game console is intended to provide the payoff pool or the payoff game, it must moderately reduce the odds of the basic game. If the player does not obtain payoffs in the payoff pool or the bonus of the payoff game due to the odds after playing for a long time, the player may think it is not worth, and the player will lose interest in playing the console after so long. In addition, players in different regions present different levels of acceptance for the payoff pool and the payoff game. After pushing a new game out, a dealer needs to perform modification and update for the players in different regions, and the push-out date of the game will be delayed. Meanwhile, troubles in management and maintenance of the console are caused, thus resulting in increase of the operating cost.

SUMMARY OF THE INVENTION

A main objective of the present invention is to disclose a game system for automatically judging whether a player makes an additional bet. When the player chooses to make the additional bet, the game system can automatically judge so as to choose to perform an additional raising game flow or a basic game flow.

For the foregoing objective, the present invention provides a game system for judging whether a player makes an additional bet. The game system cooperates with a game host to allow a player to play a game. The game host generates at least one of a plurality of game results, and these game results mark a payment odd separately. The game system includes an operating interface, a payoff pool unit and a control unit, wherein the operating interface includes a basic bet component and an additional bet component, the basic bet component allows the player to make a basic bet on these game results of the game host to hereby generate a basic bet signal including an amount of the basic bet, and the additional bet component allows the player to choose whether to make an additional bet to hereby generate an additional bet signal including an amount of the additional bet. The payoff pool unit comprises a database, the database stores a payoff value, the payoff value comprises a payoff trigger condition, and after the payoff trigger condition is triggered, a payoff winning payment value is generated according to an amount of the payoff value.

The control unit is connected to the game host, the operating interface and the payoff pool unit. When the player plays the game, the control unit executes the following steps:

after the player plays the game, allocating, according to the basic bet signal and the additional bet signal, a fixed proportion of the amount of the basic bet and the amount of the additional bet to serve as an allocating value, and allowing the database to accumulate the allocating value to increase the payoff value;

choosing to perform an additional raising game flow or a basic game flow according to the presence or absence of the additional bet signal;

in the absence of the additional bet signal and in case of conformation of a game result generated by the game host to a game result about the bet of the player, performing, by the control unit, the basic game flow to calculate a basic bet payment value according to the corresponding payment odd and the basic bet signal, and taking, by the control unit, the basic bet payment value as a basic payment value;

in the presence of the additional bet signal and in case of conformation of the game result generated by the game host to the game result about the bet of the player, performing, by the control unit, the additional raising game flow to generate an additional bet payment value in addition to calculating the basic bet payment value, judging, by the control unit, whether the payoff trigger condition is satisfied, generating, if yes, the payoff winning payment value, notifying the database to deduct the payoff winning payment value from the payoff value, and accumulating, by the control unit, the basic bet payment value, the additional bet payment value and the payoff winning payment value to serve as an additional raising payment value; and giving the basic payment value and the additional raising payment value generated by the basic game flow and the additional raising game flow respectively to the player.

According to another implementation manner, the database can store a plurality of payoff values independent of one another, the database takes an amount allocated according to the fixed proportion as an allocating value, the database accumulates the allocating value to increase the payoff values, these payoff values comprise a payoff trigger condition separately, and after the payoff trigger conditions are triggered, a payoff winning payment value is generated according to amounts of the payoff values respectively. The control unit decides, according to the amount of the additional bet, to judge whether the payoff trigger conditions corresponding to these payoff values are satisfied or not respectively, the payoff winning payment value is generated when at least one condition is satisfied, the payoff winning payment value is a multi-layer payoff value, the use quantity may be determined according to the amount of the additional bet, and therefore the aim of encouraging the player to make the additional bet is achieved, thus increasing the turnover.

Therefore, the present invention automatically judges whether a player makes an additional bet, and allows the player to be able to freely choose whether to generate the additional bet, so the player has a feeling of superiority in an independent choice for a playing method, desires to additionally obtain an additional payment in case of winning, and becomes interested in continuously playing the game. Moreover, when the player chooses to generate the additional bet, payoff values of the payoff pool unit will be accumulated, and an additional payment for additional raising can be obtained. Thus, when choosing to generate the additional bet, the player may have a feeling of multiple preferential gains to increase an interest of playing, and then the turnover can be increased.

In addition, further, through a bonus system of the present invention, a dealer can easily cater to habits of players in different regions by changing the value of the fixed proportion. For example, when a player in a region prefers a playing method namely a payoff pool unit, the present invention can increase the value of the fixed proportion to quickly accumulate payoff values, so as to increase a frequency of obtaining the payoff values of the payoff pool unit. Otherwise, the value of the fixed proportion can be reduced, a probability of making a game result generated by the game host conform to a game result about the bet of the player can be increased, the player can enjoy a feeling of easily winning each game, and the demands of the player are met. In other words, the game system of the present solution can meet demands of players in different regions simultaneously without modification and update, comprises multi-purpose functions, can shorten the push-out date of a game, can improve convenience in management and maintenance of a game host, and effectively reduces the operating cost.

DETAILED DESCRIPTION OF THE PREFERRED EMBODIMENTS

Figure 1:
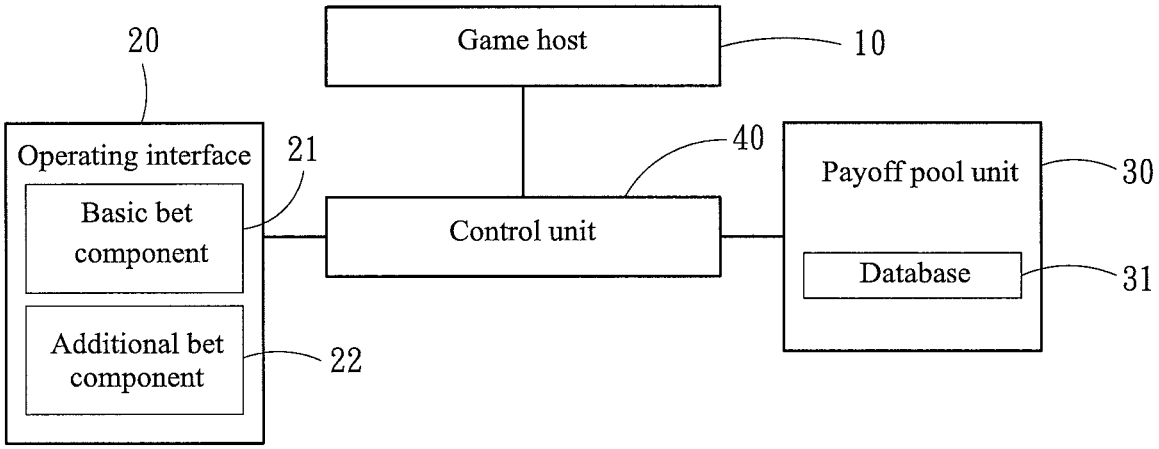
FIG. 1 is a block diagram illustrating a game system according to a first embodiment of the present invention.

The contents of the present invention will be explained and described in detail hereinbelow with reference to embodiments and drawings. The embodiments of the present invention are not intended to limit the present invention from being implemented in any of the following specific environments, applications or special manners. Thus, the following description is only intended to explain the present invention, not to limit the present invention. In the following embodiments and drawings, all components not directly associated with the present invention are omitted and not drawn, and the dimension and content of each component in the drawings are described only for the purpose of easy understanding, and are not practically implemented to limit the present invention.

A first embodiment of the present invention is a game system for judging whether a player makes an additional bet. A main block diagram of the system is as shown in FIG. 1. The game system cooperates with a game host 10 to allow a player to play a game. The game system includes the game host 10, an operating interface 20, a payoff pool unit 30 and a control unit 40.

The game host 10 comprises a plurality of game results, these game results marking a payment odd separately, and the plurality of game results being differently defined according to types of games. For dices, the plurality of game results may be 'big', 'small', 'three of a kind', 'odd', 'even' and the like, which are artificially defined. Every time a player plays a game, at least one of these game results will be generated. In other words, multiple game results may be generated simultaneously.

Figure 2:
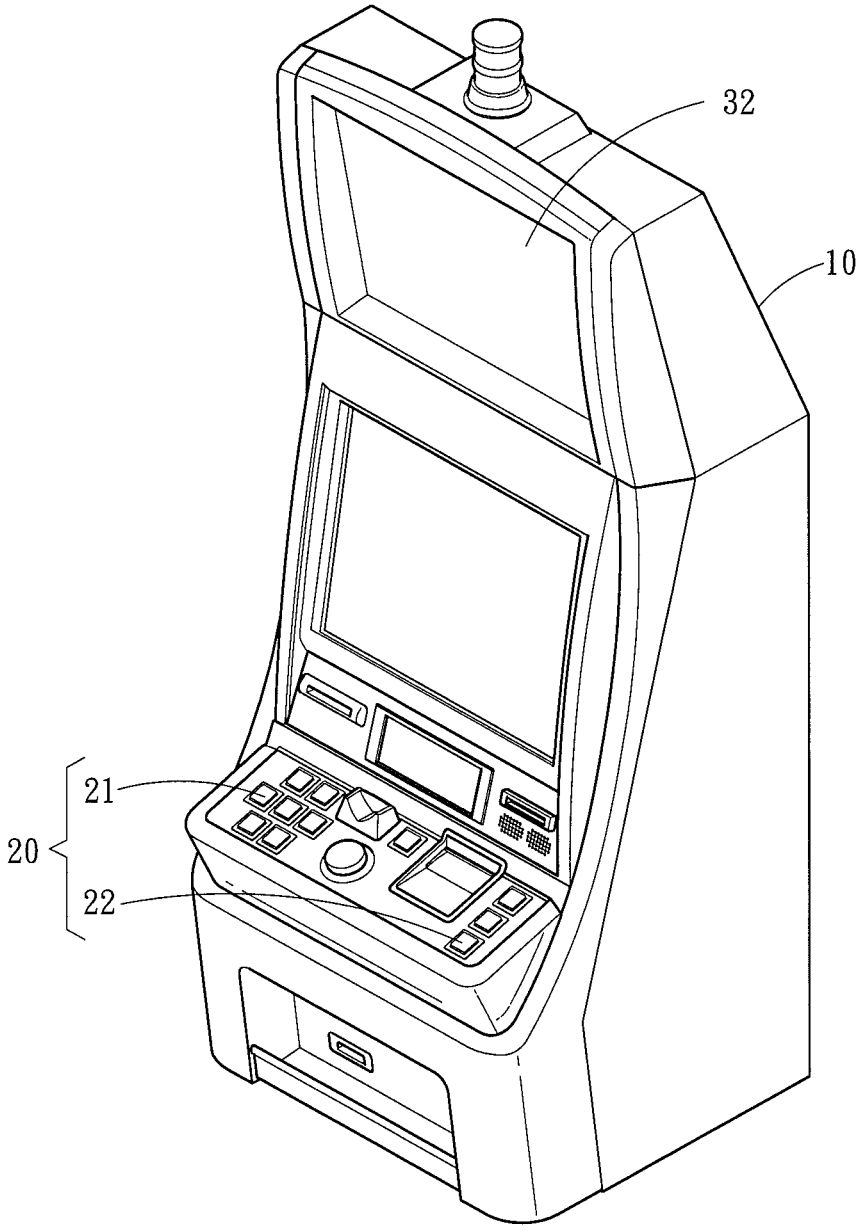
FIG. 2 is a diagram illustrating application of the game system to a game console according to the first embodiment of the present invention.

The operating interface 20 includes a basic bet component 21 and an additional bet component 22. Referring to the diagram illustrating application to a game console according to the present invention in FIG. 2, the operating interface 20 may be a physical key on an actual console, or may be a touch screen presented in a form of virtual key. In an implementation pattern as shown in FIG. 2, both the basic bet component 21 and the additional bet component 22 of the operating interface 20 are physical keys. The basic bet component 21 allows the player to make a basic bet on these game results of the game host 10 to hereby generate a basic bet signal including an amount of the basic bet, and the additional bet component 22 allows the player to choose whether to make an additional bet to hereby generate an additional bet signal including an amount of the additional bet.

Figure 3:
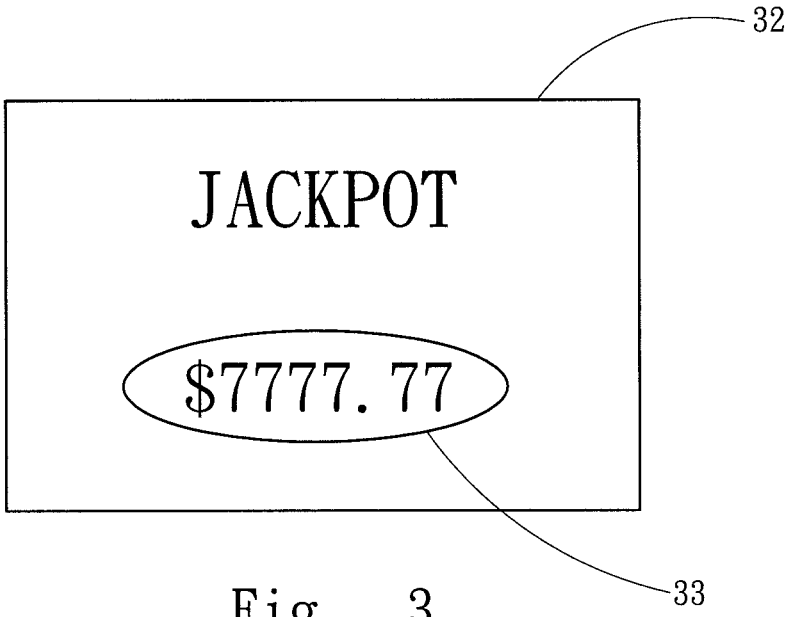
FIG. 3 is a display diagram illustrating a payoff value according to the first embodiment of the present invention.

The payoff pool unit 30 comprises a database 31, and the database 31 stores a payoff value 33. As shown in FIG. 2 and FIG. 3, the payoff value 33 may be displayed on a display billboard 32. The payoff value 33 comprises a payoff trigger condition. The payoff trigger condition may be a specified condition such as random trigger. That is, there will be opportunities for triggering every time the game is played. Or, the payoff trigger condition refers to triggering when the payoff value 33 is accumulated to reach a threshold value, the threshold value being artificially specified or randomly generated. When the payoff value 33 is accumulated to exceed the threshold value, triggering is performed. Also, the payoff trigger condition may refer to triggering when the game satisfies a specific result.

After the payoff trigger condition is triggered, the payoff pool unit 30 generates a payoff winning payment value according to an amount of the payoff value 33. Generally speaking, the amount of the payoff value 33 is the given payoff winning payment value. However, in other implementation patterns, a certain proportion (e.g., 200%) of the payoff value 33 may be specified according to the magnitude of the amount of the additional bet, or an additional bonus is added to serve as the payoff winning payment value. That is, the magnitude of the payoff winning payment value is positively correlated to the magnitude of the amount of the additional bet. Thus, the player is encouraged to make the additional bet with a higher bet amount, so as to obtain a higher payoff winning payment value.

The control unit 40 is connected to the game host 10, the operating interface 20 and the payoff pool unit 30. When the player plays the game, the control unit 40 executes the following steps.

Figure 4:
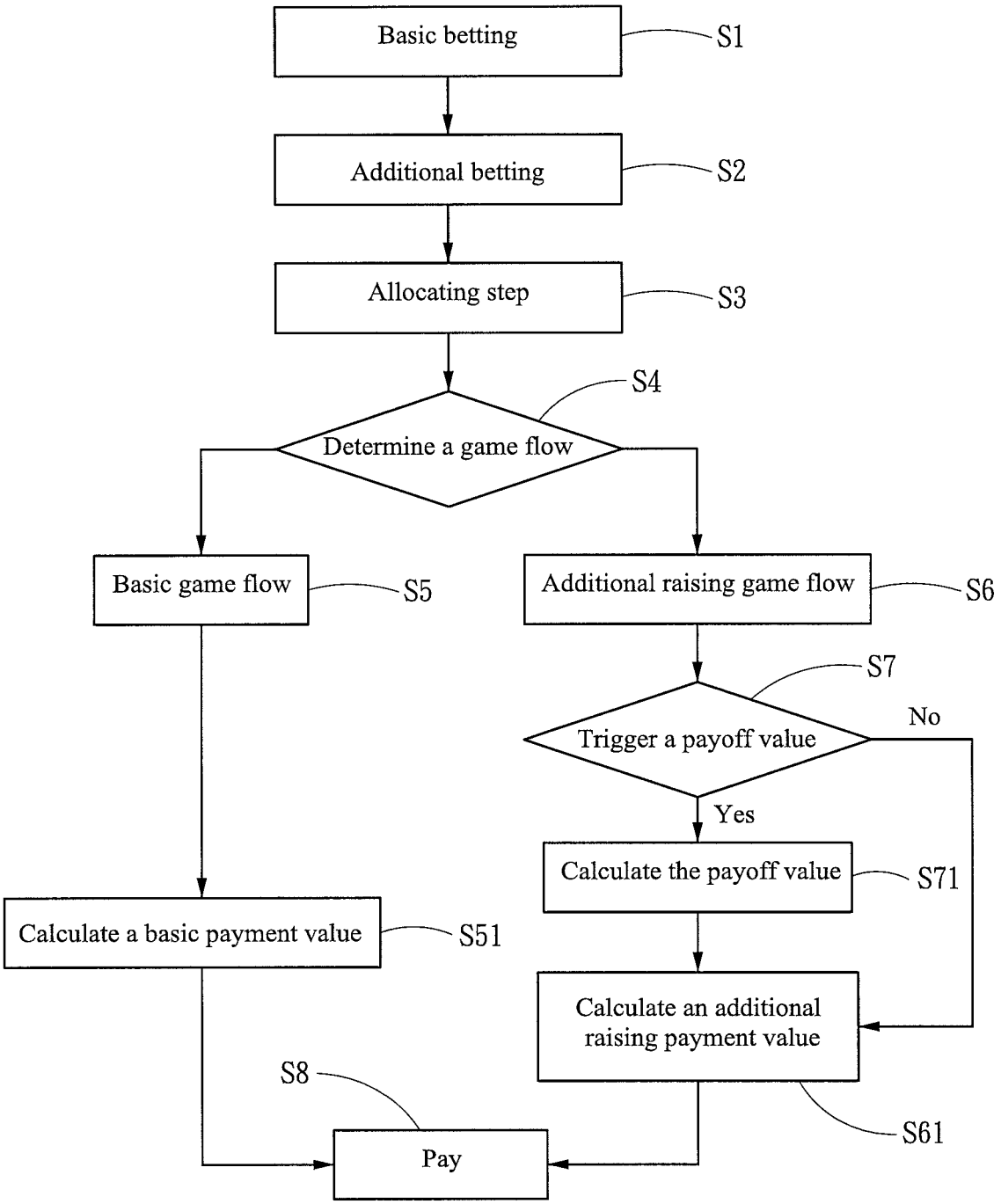
FIG. 4 is a flowchart showing a game according to the first embodiment of the present invention.

Please see a flowchart showing a game as shown in FIG. 4.

After the player plays the game, the steps S1: basic betting and S2: additional betting will be executed. The basic betting is a necessary step for the player, and the additional betting is a step freely alternative to the player. When the player plays the game and chooses to perform the basic betting and the additional betting, the basic bet component 21 will generate the basic bet signal in the step S1, and the additional bet component 22 will generate the additional bet signal in the step S2. Then, the control unit 40 automatically executes the step S3: allocating, where the control unit 40 allocates, according to the basic bet signal and the additional bet signal, a fixed proportion of the amount of the basic bet and the amount of the additional bet to serve as an allocating value, and the database 31 accumulates the allocating value to increase the payoff value 33. The allocated fixed proportion for the amount of the basic bet and the allocated fixed proportion for the amount of the additional bet may be identical or different.

Then, the step S4: determining a game flow is executed. The control unit 40 chooses to perform an additional raising game flow or a basic game flow according to the presence or absence of the additional bet signal.

In the absence of the additional bet signal, that is, when the player chooses not to make the additional bet, the step S5: performing a basic game flow is executed. In the absence of the additional bet signal and in case of conformation of the game result generated by the game host 10 to the game result about the bet of the player, the control unit 40 performs the basic game flow to calculate a basic bet payment value according to the corresponding payment odd and the basic bet signal. Then, the step S51: calculating a basic payment value is executed, where the control unit 40 takes the basic bet payment value as a basic payment value.

In the presence of the additional bet signal, that is, when the player chooses to make the additional bet, the step S6: performing an additional raising game flow is executed. In the presence of the additional bet signal and in case of conformation of the game result generated by the game host 10 to the game result about the bet of the player, the control unit 40 performs the additional raising game flow, and the game host 10 generates an additional bet payment value in addition to calculating the basic bet payment value. Then, the step S7: triggering the payoff value 33 is executed, where the control unit 40 judges whether the payoff trigger condition is satisfied. If yes, the step S71: calculating the payoff value 33 is executed, where the payoff pool unit 30 generates the payoff winning payment value, and transmits the payoff winning payment value to notify the control unit 40, and the control unit 40 notifies the database 31 of the payoff pool unit 30 to deduct the payoff winning payment value from the payoff value 33. Then, the step S61: calculating an additional raising payment value is executed, where the control unit 40 accumulates the basic bet payment value, the additional bet payment value and the payoff winning payment value to serve as an additional raising payment value.

Finally, the step S8: payment is executed. If the player chooses to execute the step S5: performing the basic game flow instead of the step of additional betting, the control unit 40 gives the basic payment value, generated by performing the basic game flow, to the player in the step S8. However, if the player chooses to perform additional betting and to execute the step S6: performing the additional raising game flow, the control unit 40 gives the additional raising payment value, generated by performing the additional raising game flow, to the player in the step S8.

In other words, the basic bet payment value is a basic payment generated for the plurality of game results of the game host 10 according to a basic rule of the played game, and an additional bet payment will not change the basic payment and the basic rule, but enhances feedback of an additional bet amount of the player to the player according to an additional payment rule in a manner of additionally generating an additional bet payment value.

Figure 5:
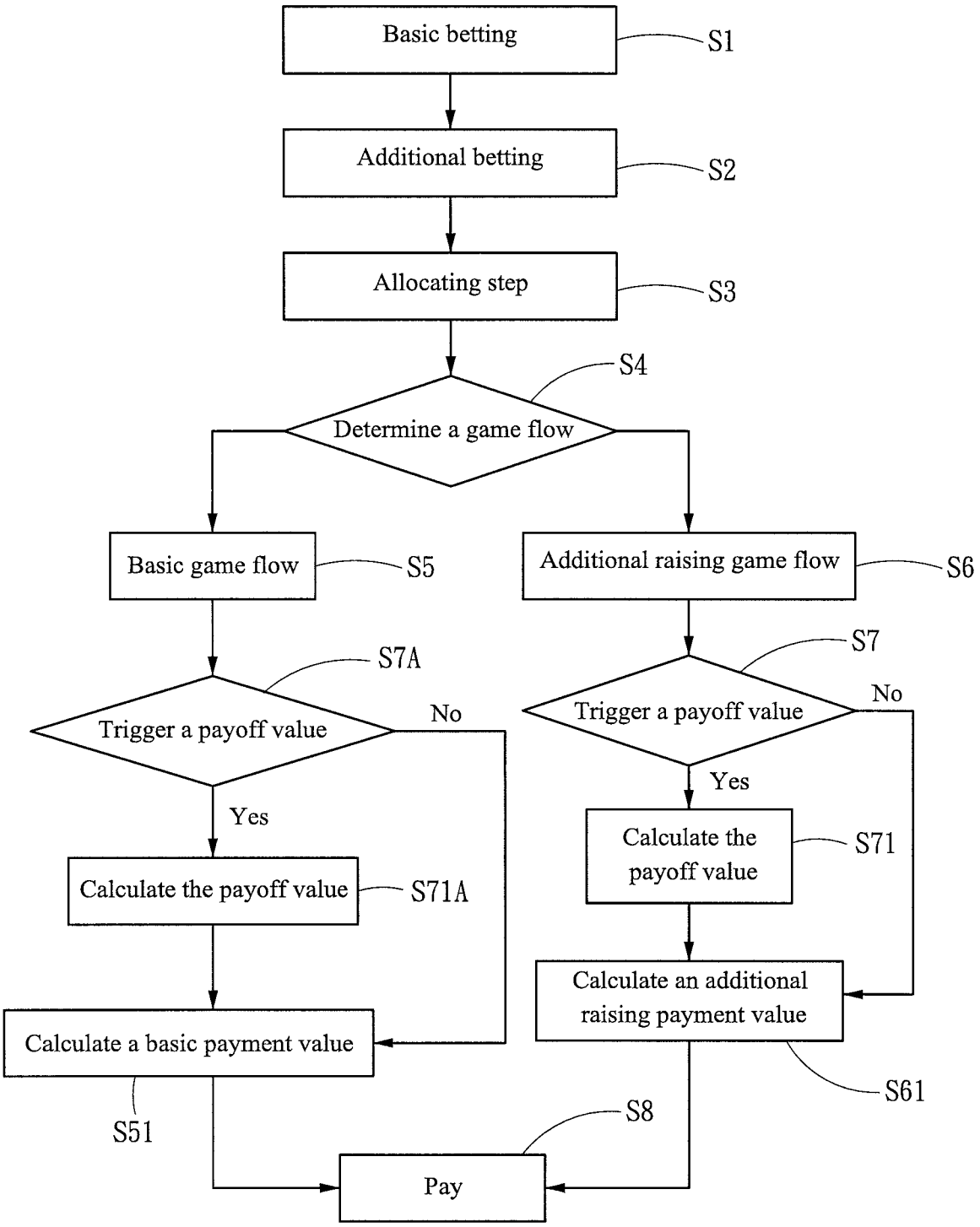
FIG. 5 is a flowchart showing a game according to another implementation pattern of the first embodiment of the present invention.

FIG. 5 shows a flowchart of a game according to another implementation pattern of the first embodiment. The difference from the previous implementation pattern lies in that: after the step S5: performing the basic game flow is executed, a step S7A: triggering the payoff value 33 is executed, where the control unit 40 judges whether the payoff trigger condition is satisfied. If yes, a step S71A: calculating the payoff value 33 is executed, where the payoff pool unit 30 generates the payoff winning payment value, and transmits the payoff winning payment value to notify the control unit 40, and the control unit 40 notifies the database 31 of the payoff pool unit 30 to deduct the payoff winning payment value from the payoff value 33. The step S51: calculating the basic payment value is executed, where the control unit 40 accumulates the basic bet payment value and the payoff winning payment value to serve as the basic payment value.

To make the player understand the amount of the additional bet and reduce the complexity of payment calculation, the amount of the additional bet is a fixed proportion of the amount of the basic bet. For example, the fixed portion may be any one selected from 20%, 40%, 60%, 80% and 100%, which makes it convenient for the player to quickly choose to make the additional bet.

There may be multiple manners of generating the additional bet payment value. For example, the additional bet payment value may be a product obtained by multiplying the basic bet payment value by a proportion value. The proportion value may be set by a dealer or randomly generated. Or, the proportion value is positively correlated to a quantity value of the amount of the additional bet to encourage the player to increase the additional bet. For example, when the additional bet is 20%, 40%, 60%, 80% and 100%, the proportion value may be 20%, 40%, 60%, 80% and 100% correspondingly. Or, in order to increase the value of the fixed proportion, namely to increase the speed of accumulating into the payoff value, the proportion value may be reduced to 15%, 35%, 55%, 75% and 95% properly, and the reduced part is transferred to the fixed proportion. Or, the proportion value may be random and is selected from any one of a string of numbers. If the additional bet is 50%, the proportion value may be any one randomly selected from 50%, 100%, 150%, 200% and 250%, and the excitement of the game can be improved.

Figure 6:
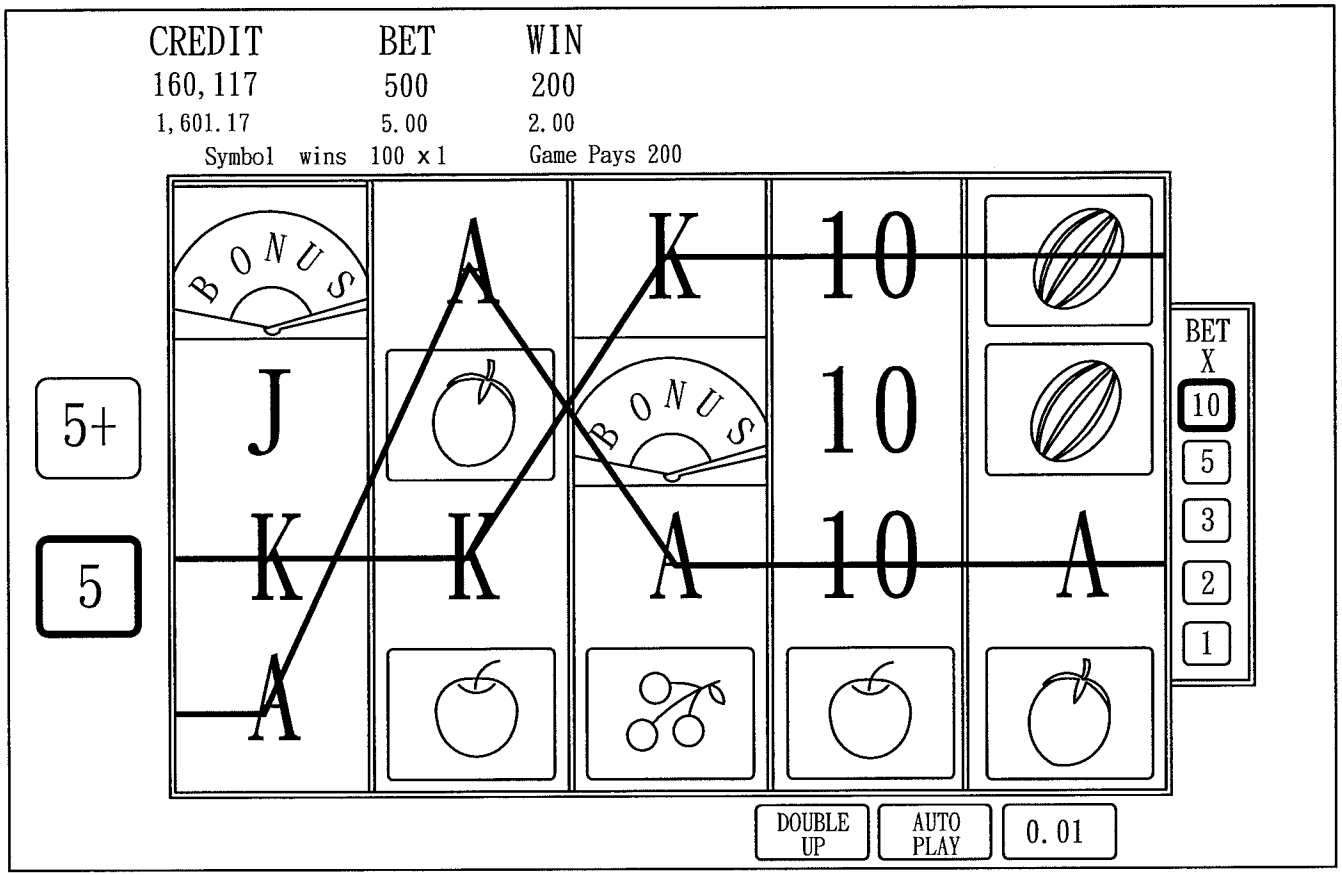
FIG. 6 is a diagram illustrating a game picture about a basic bet according to the first embodiment of the present invention.
Figure 7:
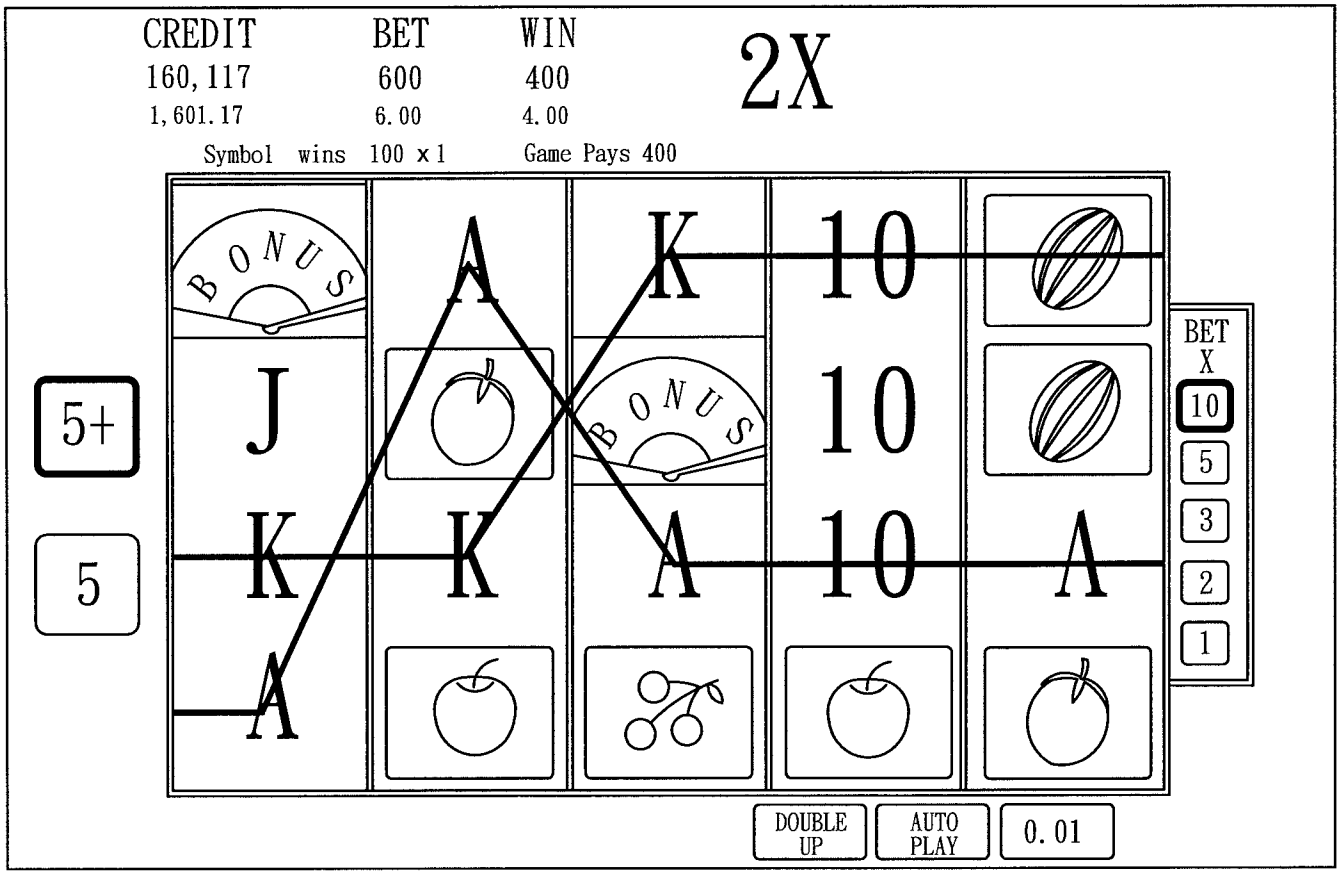
FIG. 7 is a diagram illustrating a game picture about an additional bet according to the first embodiment of the present invention.

For convenience of understanding of an operating mechanism of the additional bet payment value, the scenario that the additional bet payment value is a product obtained by multiplying the basic bet payment value by a proportion value will be taken as an example for illustration hereinbelow. FIG. 6 and FIG. 7 are diagrams illustrating game pictures, about a basic bet and an additional bet, presented by one of these game results generated by the game host 10 according to the first embodiment of the present invention. As shown in the figures, a betting option of the basic bet is 5, a betting option of the additional bet is 5+, betting multiple options include 1, 2, 4, 6 and 10, and denomination options include 0.01, 0.02 and the like. Please see FIG. 6 first, if a player chooses a basic bet (a betting option is 5), a betting multiple is 10 and denomination is set as 0.01, the value of the basic bet is 500. As shown in the figure, two game results generated by the game host 10 conform to two game results about the bet of the player, and a basic bet payment value is 200. As shown in FIG. 7, if the player chooses an additional bet (a betting option is 5+) but makes the same choices for other options as shown in FIG. 6, the amount of the additional bet is 20% of the amount of the basic bet, so the total bet amount of the player is 600. When the player makes the additional bet and the game host 10 generates two results conforming to the bet of the player likewise, the proportion value is randomly selected as 100%. In this case, the player can obtain the basic bet payment value 200 as well as an additional bet payment value 200, and an effect of enabling the player to obtain double amounts of the original payment value (i.e., 200%) is presented on a display picture. If the payoff trigger condition is satisfied at this moment, a payment value that can be obtained by the player is an additional raising payment value obtained by totaling the foregoing basic bet payment value and the additional bet payment value as well as the payoff winning payment value during triggering. It is important to note that the betting and betting multiple options of the basic bet and the additional bet, set above, are only exemplary. A person skilled in the art may easily spread to other amounts. Besides, all game types, game contents, manners, results and numbers mentioned above and shown in the figures are examples, and are not limited in the present invention.

Figure 8:
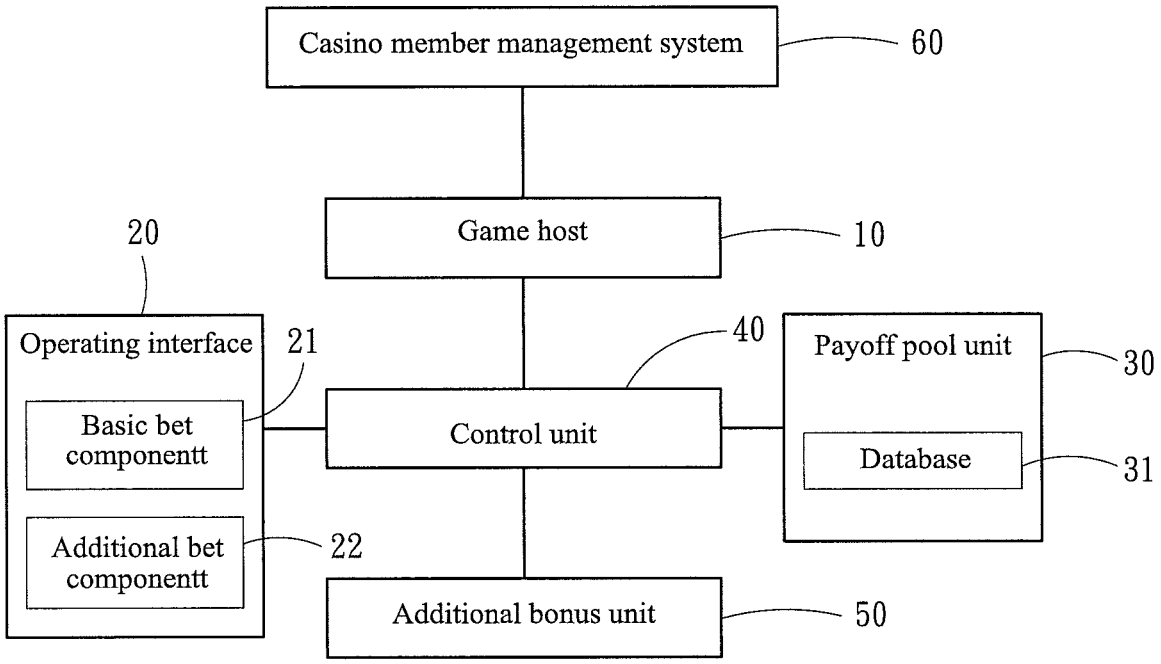
FIG. 8 is a block diagram illustrating a game system according to another implementation pattern of the first embodiment of the present invention.

FIG. 8 is a block diagram illustrating a game system according to another implementation pattern of the first embodiment of the present invention. As shown in the figure, the game system may further include an additional bonus unit 50 connected to the control unit 40 and a casino management system (CMS) 60, wherein the additional bonus unit 50 generates, according to whether a specified condition is satisfied, an additional payoff game having a plurality of game rounds, the player plays the payoff game to gain an additional bonus, and the additional bonus is added to the additional bet payment value.

In this implementation pattern, the specified condition may be random trigger after a total bet value of the player satisfies a threshold value. Also, after the threshold value is satisfied, an additional payoff game, an additional payoff or an additional multiplying bonus can be randomly triggered. Further, when the player continues playing and the payoff value 33 is accumulated to exceed the threshold value, at least one trigger round can be randomly generated during continuous playing.

During practical implementation, the total bet value may be a sum of the amount of the basic bet and the amount of the additional bet, or may be merely a total value of the amount of the additional bet. Thus, as long as the player plays the game for a certain round, the additional payoff game can be generated definitely, the quantity of game rounds of the additional payoff game depends on a quantity value of the additional bet, the quantity of the game rounds will be larger as the quantity value is larger, and the total bet value may be fixed or may be increased or decreased according to the nationality or region corresponding to a game player, thus catering to hobbies of players in different places.

For convenience of statistics on the total bet value of the player, the game host 10 in this pattern is connected to the casino management system 60, so as to synchronously store relevant bet data into member data of the casino management system 60.

Figure 9:
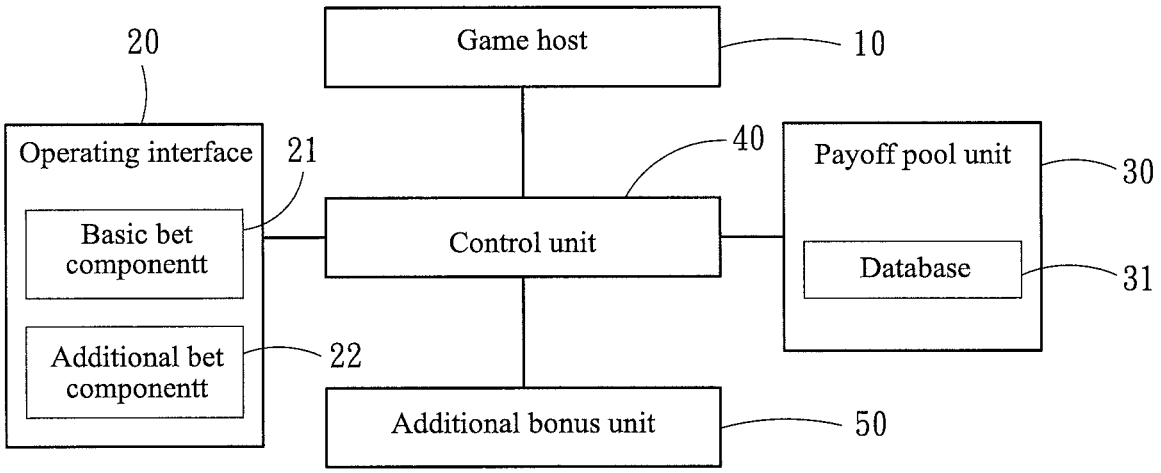
FIG. 9 is a block diagram illustrating a game system according to a further implementation pattern of the first embodiment of the present invention.

FIG. 9 is a block diagram illustrating a game system according to a further implementation pattern of the first embodiment of the present invention. As shown in the figure, the game system only further includes an additional bonus unit 50. In the game system in this pattern, the control unit 40 will generate, according to whether these game results satisfy a payoff game trigger condition, a payoff game having a plurality of game rounds. For example, the payoff game trigger condition may be, but not limited to, generation of a specific symbol or linking when the result of the game satisfies a specified condition. When the player chooses to make the additional bet and the payoff game is generated, the additional bonus unit 50 enables the player to gain an additional bonus in a process of playing the payoff game, and adds the additional bonus to the additional bet payment value.

For example, the control unit 40 may additionally increase the quantity of the plurality of game rounds according to the additional bet, so the player plays the payoff game, gains the additional bonus, and adds the additional bonus to the additional bet payment value. For example, when the player merely makes the basic bet and enters the payoff game after the game result satisfies the payoff game trigger condition, the quantity of obtained game rounds of the payoff game is, e.g., 10. However, when the player also chooses to make the additional bet and also enters the payoff game, the quantity of obtained game rounds of the payoff game will be additionally increased by the control unit 40 to, e.g., 12 according to the additional bet. Furthermore, when an additional payoff game is re-triggered in this payoff game process, additional payoff game rounds that can be obtained in an additional raising game flow will be more than additional payoff game rounds that can be obtained in a basic game flow.

For another example, when the player chooses to make the additional bet and the payoff game is generated, in this payoff game process, if the game result generated by the game host conforms to the game result about the bet of the player, the control unit 40 may additionally increase the corresponding payment odd according to the additional bet, e.g., may multiply the payment odd that can be obtained by the basic bet by a number greater than 100%.

Through a bonus that can be obtained by additionally increasing the payoff game, the player can be encouraged to increase the additional bet, so as to have a feeling of hitting the jackpot in addition to those having been won. It is important to note that this additional bonus can be presented on the payoff game in various manners, and is not limited in the above two examples.

Figure 10:
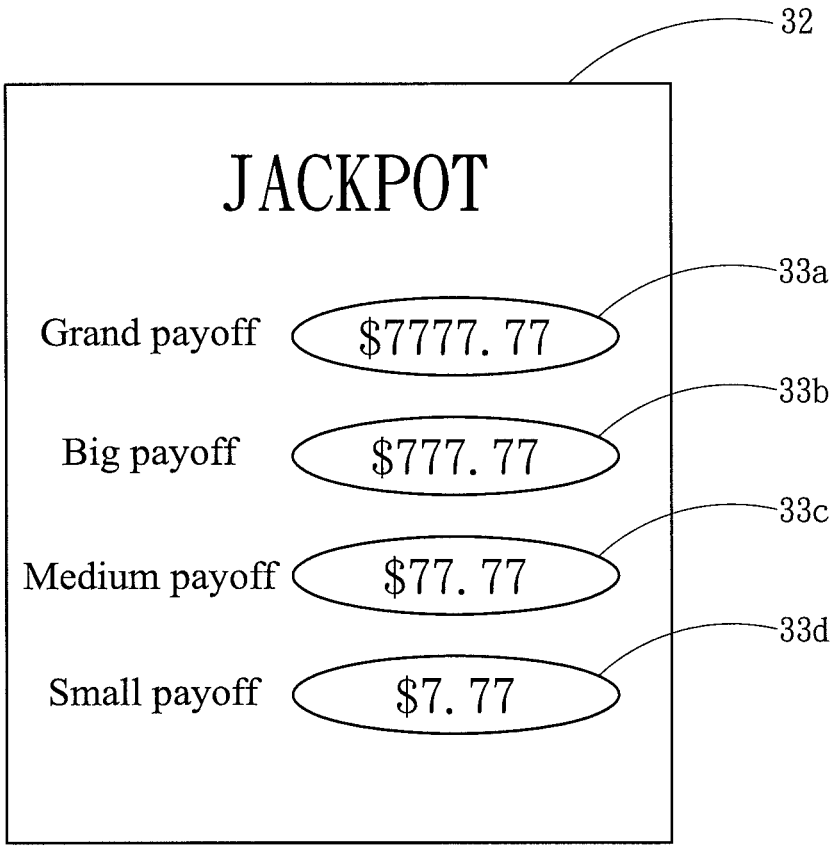
FIG. 10 is a display diagram illustrating a payoff value according to a second embodiment of the present invention.

FIG. 10 shows a display diagram illustrating a payoff value according to a second embodiment of the present invention. The difference from the first embodiment lies in that the database 31 of the payoff pool unit 30 may store a plurality of payoff values 33*a*, 33*b*, 33*c* and 33*d* independent of one another. As shown in FIG. 10, the payoff values 33*a*, 33*b*, 33*c* and 33*d* of the present embodiment are set as four layers, including a grand bonus, a big bonus, a medium bonus and a small bonus. These payoff values 33*a*, 33*b*, 33*c* and 33*d* comprise a payoff trigger condition separately, and after the payoff trigger conditions are triggered, a payoff winning payment value is generated according to amounts of these payoff values 33*a*, 33*b*, 33*c* and 33*d* respectively. The payoff trigger conditions may be as mentioned in the previous embodiment.

The control unit 40 allocates, according to the basic bet signal and the additional bet signal, a fixed proportion of the amount of the basic bet and the amount of the additional bet to serve as an allocating value, and allows the database 31 to distribute the allocating value to increase these payoff values 33*a*, 33*b*, 33*c* and 33*d* respectively. The fixed proportion allocated for the amount of the basic bet and the amount of the additional bet may be averagely distributed and added to these payoff values 33*a*, 33*b*, 33*c* and 33*d*, or may be distributed and added in different proportions. Then, the control unit 40 decides to judge whether the payoff trigger conditions corresponding to these payoff values 33*a*, 33*b*, 33*c* and 33*d* are satisfied respectively according to the amount of the additional bet, and generates, when at least one payoff trigger condition is satisfied, the payoff winning payment value.

The use quantity of the payoff values 33*a*, 33*b*, 33*c* and 33*d* can be determined according to the amount of the additional bet. That is, the use quantity of these payoff values 33*a*, 33*b*, 33*c* and 33*d* is larger as the amount of the additional bet is larger. For example, if there are four layers of these payoff values 33*a*, 33*b*, 33*c* and 33*d*, namely four layers of payoff values 33*a*, 33*b*, 33*c* and 33*d* (a grand bonus, a big bonus, a medium bonus and a small bonus, respectively) in the present embodiment as shown in FIG. 10, every time the player bets, no matter whether to merely make the basic bet or simultaneously make the additional bet, the fixed proportion of a bet amount will be distributed into these payoff values 33*a*, 33*b*, 33*c* and 33*d*.

When the amount of the additional bet is higher, the use quantity of the payoff trigger conditions for these payoff values 33*a*, 33*b*, 33*c* and 33*d* will be higher. For example, the additional bet is 20%, 40%, 60%, 80% and 100%. When the additional bet is 20% and 40%, the small-bonus payoff trigger condition may be adopted. When the additional bet is 40% and 60%, the small-bonus and medium-bonus payoff trigger conditions may be adopted. When the additional bet is 60% and 80%, the small-bonus, medium-bonus and big-bonus payoff trigger conditions may be adopted. When the additional bet is 80% and 100%, the small-bonus, medium-bonus, big-bonus and grand-bonus payoff trigger conditions may be adopted. The magnitude of the additional bet affects the use quantity of the payoff trigger conditions for these payoff values 33*a*, 33*b*, 33*c* and 33*d*, and furthermore, the control unit 40 may change the magnitude of the payoff winning payment in a positive correlation manner according to the magnitude of the additional bet. For example, when the additional bet is 20% and 40%, although the small-bonus payoff trigger condition is adopted likewise, compared with the situation that the additional bet is 20%, the situation that the additional bet is 40% is characterized in that the payoff winning payment value is larger, so the aim of encouraging the player to make the additional bet can be achieved, thus increasing the turnover.

In the second embodiment, various implementation patterns of the first embodiment can be applied. For example, the additional bonus unit 50 and the casino management system 60 are cooperatively used, or only the additional bonus unit 50 is used. The whole game flow is the same as that in the first embodiment, and will not be repeated herein.

Figure 11:
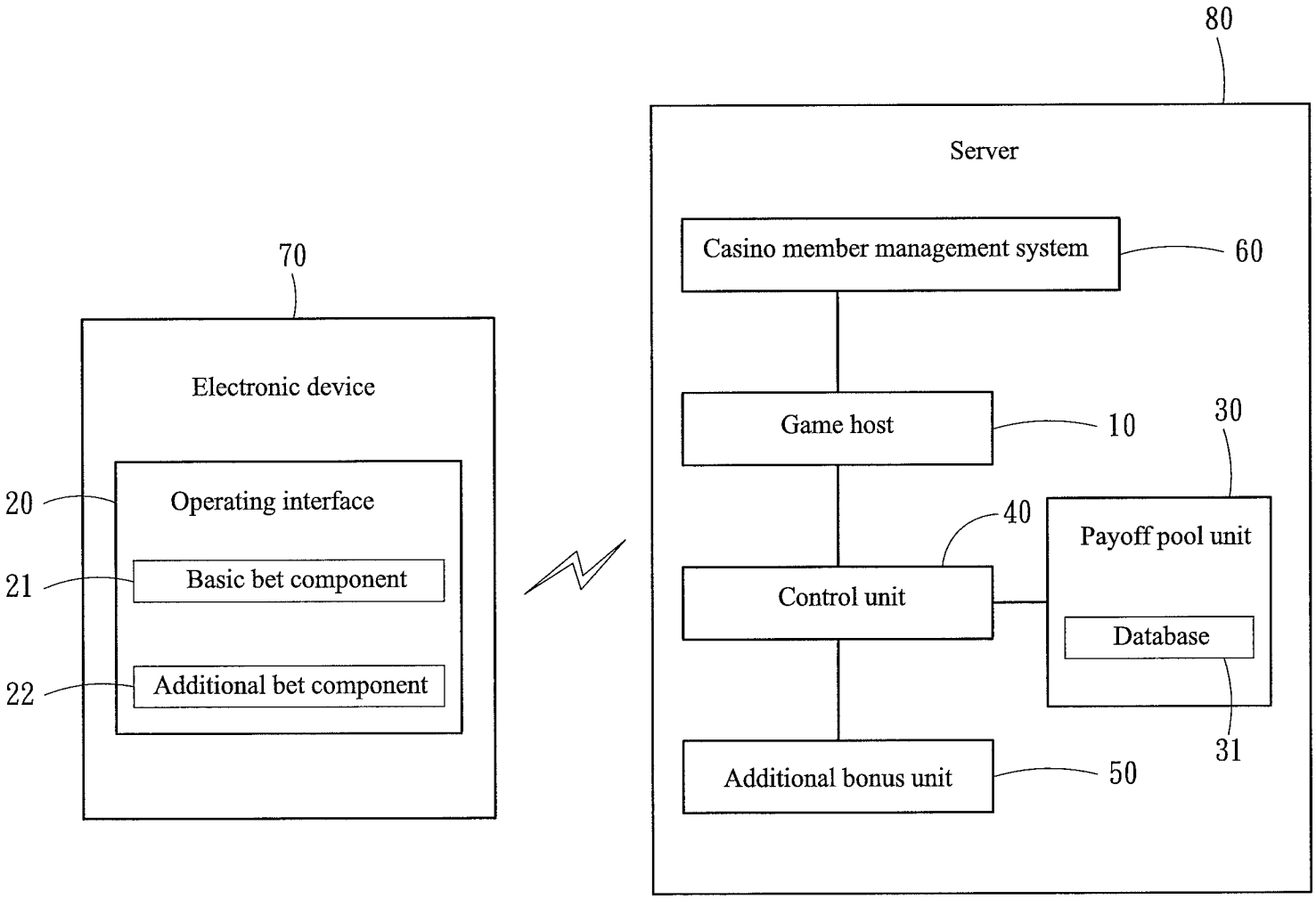
FIG. 11 is a block diagram illustrating a game system according to a third embodiment of the present invention.

In each of the foregoing embodiments and implementation patterns, the game system is applied to a game console. However, the present invention can also be applied to an online game environment. As shown in a third embodiment of the present invention as shown in FIG. 11, in the game system of this embodiment, an operating interface 20 is disposed in an electronic device 70. The electronic device 70 may be various electronic devices such as a personal computer, a pad or a mobile phone, and comprises a display screen (not shown in the figure). The electronic device 70 communicates with a server 80 in a wired or wireless manner. The server 80 includes a game host 10, a payoff pool unit 30, a control unit 40 and a casino management system 60, and selectively comprises an additional bonus unit 50. The technical features of each of the foregoing embodiments and implementation patterns can be applied to this embodiment. The main difference lies in that a location of each of the foregoing components and a signal transmission interface are network-based, so the similarities will not be elaborated herein.

As above, the present invention at least comprises the following advantages:

1. The present invention automatically judges whether a player makes an additional bet, and allows the player to be able to freely choose whether to generate the additional bet, so the player has a feeling of superiority in an independent choice for a playing method, desires to additionally obtain an additional payment in case of winning, and becomes interested in continuously playing the game. Moreover, when the player chooses to generate the additional bet, payoff values of the payoff pool unit will be accumulated, and an additional payment for additional raising can be obtained. Thus, when choosing to generate the additional bet, the player may have a feeling of multiple preferential gains to increase an interest of playing, and then the turnover can be increased.

2. A dealer can easily cater to habits of players in different regions by changing the value of the fixed proportion without modification and update, and comprises multipurpose functions. When a player in a region prefers a playing method namely a payoff pool unit, the present invention can increase the value of the fixed proportion to quickly accumulate payoff values, so as to increase a frequency of obtaining the payoff values of the payoff pool unit. Otherwise, the value of the fixed proportion can be reduced, the rate of return of the game can be increased, the player can enjoy a feeling of easily winning each game, and the demands of the player are met.

3. The push-out period of a game can be shortened, convenience in management and maintenance of a console can be improved, and the operating cost is effectively reduced.

4. The payoff pool unit comprises multiple payoff values, so the player can adopt the payoff values one by one by increasing the amount of the additional bet, and the player can be attracted to increase the additional bet, thus increasing the turnover of the game console.

5. An additional raising amount is generated according to a quantity value of the additional bet, and meanwhile, an additional payment is additionally obtained by the player according to the additional raising amount. Therefore, the player can obtain a larger additional payment by choosing a larger additional bet, thus meeting the demand for increasing the turnover of the game console.

Therefore, the document of the present invention that is extremely progressive and conforms to the conditions about applying for patent for the invention is filed according to laws. It will be appreciated that the patent office may grant the patent as soon as possible.

The present invention has been described in detail as above. The above is only a preferable embodiment of the present invention, and cannot limit the scope of implementation of the present invention. All equivalent changes and modifications made within the scope of application of the present invention shall fall within the patent scope of the present invention.

What is claimed is:

1. A game system for judging whether a player makes an additional bet, the game system cooperating with a game host to allow a player to play a game, the game host generating at least one of a plurality of game results, these game results marking a payment odd separately, and the game system comprising:

an operating interface, the operating interface comprising a basic bet component and an additional bet component, the basic bet component allowing the player to make a basic bet on these game results of the game host to hereby generate a basic bet signal including an amount of the basic bet, and the additional bet component allowing the player to choose whether to make an additional bet to hereby generate an additional bet signal including an amount of the additional bet;

a payoff pool unit, the payoff pool unit having a database, the database storing a payoff value, the payoff value having a payoff trigger condition, and after the payoff trigger condition is triggered, a payoff winning payment value being generated according to an amount of the payoff value; and a control unit, the control unit being connected to the game host, the operating interface and the payoff pool unit, and when the player plays the game, the control unit executing the following steps automatically:

detecting the basic bet signal and the additional bet signal, from the operating interface, allocating a fixed proportion of the amount of the basic bet and the amount of the additional bet serving as an allocating value, and commanding the database to accumulate the allocating value to increase the payoff value, after the player plays the game; wherein the fixed proportion is a variable value preset by a dealer before the player starts to play a game, and the fixed proportion of the amount of the basic bet and the fixed proportion of the amount of the additional bet are allocated in a value which is the same or different;

determining whether the game host executes an additional raising game flow if the additional bet signal is received or a basic game flow if the additional bet signal is not received; and wherein the control unit performing the basic game flow calculates a basic bet payment value according to the corresponding payment odd and the basic bet signal, and takes the basic bet payment value as a basic payment value, if a game result generated by the game host consisting with a game result bet by the player and without receiving the additional bet signal; and wherein the control unit performing the additional raising game flow generates an additional bet payment value in addition to calculating the basic bet payment value, the control unit judges that if satisfying with the payoff trigger condition to further generate the payoff winning payment value and to notify the database to deduct the payoff winning payment value from the payoff value, and the control unit accumulates the basic bet payment value, the additional bet payment value and the payoff winning payment value to serve as an additional raising payment value, if the game result generated by the game host consisting with the game result bet by the player and with receiving the additional bet signal;

commanding the paying the basic payment value and the additional raising payment value generated by the basic game flow and the additional raising game flow respectively to the player.

2. The game system for judging whether the player makes the additional bet according to claim 1, wherein the magnitude of the payoff winning payment value is positively correlated to that of the amount of the additional bet.

3. The game system for judging whether the player makes the additional bet according to claim 1, wherein the additional bet payment value is a product obtained by multiplying the basic bet payment value by a proportion value.

4. The game system for judging whether the player makes the additional bet according to claim 3, wherein the proportion value is positively correlated to a quantity value of the amount of the additional bet.

5. The game system for judging whether the player makes the additional bet according to claim 3, wherein the proportion value is random and is selected from any one of a string of numbers.

6. The game system for judging whether the player makes the additional bet according to claim 1, further comprising an additional bonus unit connected to the control unit, wherein the additional bonus unit generates, according to whether a specified condition is satisfied, an additional payoff game having a plurality of game rounds, the player plays the payoff game to gain an additional bonus, and the additional bonus is added to the additional bet payment value.

7. The game system for judging whether the player makes the additional bet according to claim 6, wherein the additional payoff game is randomly triggered after a total bet value of the player satisfies a threshold value.

8. The game system for judging whether the player makes the additional bet according to claim 7, wherein the game host allows to choose and set whether to synchronously store the total bet value of the additional bonus unit, according to whether the specified condition is satisfied, into member data of a casino management system.

9. The game system for judging whether the player makes the additional bet according to claim 1, further comprising an additional bonus unit connected to the control unit, wherein the control unit generates, according to whether these game results satisfy a payoff game trigger condition, a payoff game having a plurality of game rounds, and when the player chooses to make the additional bet and the payoff game is generated, the additional bonus unit enables the player to gain an additional bonus in a process of playing the payoff game, and adds the additional bonus to the additional bet payment value.

10. The game system for judging whether the player makes the additional bet according to claim 1, wherein the amount of the additional bet is a fixed proportion of the amount of the basic bet.

11. The game system for judging whether the player makes the additional bet according to claim 10, wherein the amount of the additional bet is a fixed proportion of the amount of the basic bet, and is any one selected from 20%, 40%, 60%, 80% and 100%.

12. The game system for judging whether the player makes the additional bet according to claim 1, wherein the payoff trigger condition is random trigger.

13. The game system for judging whether the player makes the additional bet according to claim 1, wherein the payoff trigger condition refers to triggering when the payoff value is accumulated to reach a threshold value.

14. The game system for judging whether the player makes the additional bet according to claim 1, wherein the basic game flow further comprises: judging whether the payoff trigger condition is satisfied, generating, if yes, the payoff winning payment value, and accumulating, by the control unit, the basic bet payment value and the payoff winning payment value to serve as the basic payment value.

15. A game system for judging whether a player makes an additional bet, the game system cooperating with a game host to allow a player to play a game, the game host generating at least one of a plurality of game results, these game results marking a payment odd separately, and the game system comprising:

an operating interface, the operating interface comprising a basic bet component and an additional bet component, the basic bet component allowing the player to make a basic bet on these game results of the game host to hereby generate a basic bet signal including an amount of the basic bet, and the additional bet component allowing the player to choose whether to make an additional bet to hereby generate an additional bet signal including an amount of the additional bet;

a payoff pool unit, the payoff pool unit having a database, the database storing a plurality of payoff values independent of one another, these payoff values having a payoff trigger condition separately, and after the payoff trigger conditions are triggered, a payoff winning payment value being generated according to amounts of these payoff values; and a control unit, the control unit being connected to the game host, the operating interface and the payoff pool unit, and when the player plays the game, the control unit executing the following steps automatically:

detecting the basic bet signal and the additional bet signal, from the operating interface, allocating a fixed proportion of the amount of the basic bet and the amount of the additional bet serving as an allocating value, and commanding the database to accumulate the allocating value to increase these payoff values, after the player plays the game; wherein the fixed proportion is a variable value preset by a dealer before the player starts to play a game, and the fixed proportion of the amount of the basic bet and the fixed proportion of the amount of the additional bet are allocated in a value which is the same or different;

determining whether the game host executes an additional raising game flow if the additional bet signal is received or a basic game flow if the additional bet signal is not received; and wherein the control unit performing the basic game flow calculates a basic bet payment value according to the corresponding payment odd and the basic bet signal, and takes the basic bet payment value as a basic payment value, if a game result generated by the game host consisting with a game result bet by the player and without receiving the additional bet signal; and wherein the control unit performing the additional raising game flow generates an additional raising payment value in addition to calculating the basic bet payment value, the control unit judges that if at least one of the payoff trigger conditions corresponding to these payoff values is satisfied respectively according to the amount of the additional bet, to further generate the payoff winning payment value and to notify the database to deduct the payoff winning payment value from the corresponding payoff value, and the control unit accumulates the basic bet payment value, the additional bet payment value and the payoff winning payment value to serve as an additional raising payment value, if the game result generated by the game host consisting with the game result bet by the player and with receiving the additional bet signal;

commanding to paying the basic payment value and the additional raising payment value generated by the basic game flow and the additional raising game flow respectively to the player.

16. The game system for judging whether the player makes the additional bet according to claim 15, wherein the additional bet payment value is a product obtained by multiplying the basic bet payment value by a proportion value.

17. The game system for judging whether the player makes the additional bet according to claim 16, wherein the proportion value is positively correlated to a quantity value of the amount of the additional bet.

18. The game system for judging whether the player makes the additional bet according to claim 16, wherein the proportion value is random and is selected from any one of a string of numbers.

19. The game system for judging whether the player makes the additional bet according to claim 15, further comprising an additional bonus unit connected to the control unit, wherein the additional bonus unit generates, according to whether a specified condition is satisfied, an additional payoff game having a plurality of game rounds, the player plays the payoff game to gain an additional bonus, and the additional bonus is added to the additional bet payment value.

20. The game system for judging whether the player makes the additional bet according to claim 19, wherein the additional payoff game is randomly triggered after a total bet value of the player satisfies a threshold value.

21. The game system for judging whether the player makes the additional bet according to claim 20, wherein the game host allows to choose and set whether to synchronously store the total bet value of the additional bonus unit, according to whether the specified condition is satisfied, into member data of a casino management system.

22. The game system for judging whether the player makes the additional bet according to claim 15, further comprising an additional bonus unit connected to the control unit, wherein the additional bonus unit generates, according to whether these game results satisfy the specified condition, a payoff game having a plurality of game rounds, the control unit additionally increases the quantity of the plurality of game rounds according to the additional bet, the player plays the payoff game to gain an additional bonus, and the additional bonus is added to the additional bet payment value.

23. The game system for judging whether the player makes the additional bet according to claim 15, wherein the amount of the additional bet is a fixed proportion of the amount of the basic bet.

24. The game system for judging whether the player makes the additional bet according to claim 23, wherein the amount of the additional bet is a fixed proportion of the amount of the basic bet, and is any one selected from 20%, 40%, 60%, 80% and 100%.

25. The game system for judging whether the player makes the an additional bet according to claim 15, wherein these payoff trigger conditions are random trigger.

26. The game system for judging whether the player makes the additional bet according to claim 15, wherein these payoff trigger conditions refer to triggering when these payoff values are accumulated to reach a threshold value.

27. The game system for judging whether the player makes the additional bet according to claim 15, wherein the basic game flow further comprises: deciding, or not, to judge whether the payoff trigger conditions corresponding to these payoff values are satisfied respectively according to the amount of the additional bet, generating, when at least one condition is satisfied, the payoff winning payment value, and accumulating, by the control unit, the basic bet payment value and the payoff winning payment value to serve as the basic payment value.

28. The game system for judging whether the player makes the additional bet according to claim 15, wherein the quantity of the payoff trigger conditions of these payoff values needing to perform judgment is positively correlated to the quantity value of the amount of the additional bet.

29. The game system for judging whether the player makes the additional bet according to claim 15, wherein the control unit changes a quantity value of the payoff winning payment value in a positive correlation manner according to the quantity value of the amount of the additional bet.

* * * * *